US010364068B1

(12) United States Patent
Kacines

(10) Patent No.: US 10,364,068 B1
(45) Date of Patent: Jul. 30, 2019

(54) HALLOWEEN BAG WITH POP-UP SURPRISE

(71) Applicant: Jeffery J. Kacines, Allen, TX (US)

(72) Inventor: Jeffery J. Kacines, Allen, TX (US)

( * ) Notice: Subject to any disclaimer, the term of this patent is extended or adjusted under 35 U.S.C. 154(b) by 197 days.

(21) Appl. No.: 15/287,186

(22) Filed: Oct. 6, 2016

(51) Int. Cl.
*B65D 33/00* (2006.01)
*B65D 33/02* (2006.01)
*B65D 33/10* (2006.01)

(52) U.S. Cl.
CPC ..... *B65D 33/004* (2013.01); *B65D 33/02* (2013.01); *B65D 33/105* (2013.01)

(58) Field of Classification Search
CPC ..... B65D 33/004; B65D 33/02; B65D 33/105
USPC ..... 206/457; 383/127, 61.4; 40/124.06, 40/124.08; 446/310
See application file for complete search history.

(56) References Cited

U.S. PATENT DOCUMENTS 2,565,076 A * 8/1951 Haubrick ..... A45C 3/06 132/296
3,623,263 A * 11/1971 Frampton ..... A63H 13/16 206/804
3,702,675 A * 11/1972 Bajo ..... B65D 5/36 206/457
3,937,394 A 2/1976 Netschert
4,194,629 A * 3/1980 Ledman ..... B65D 85/00 206/573
D258,205 S 2/1981 Kroll
4,379,519 A 4/1983 Sherwood
5,055,084 A * 10/1991 Jokic ..... A63H 13/16 40/539
5,441,348 A * 8/1995 Valentino ..... B65D 33/004 206/457
5,613,312 A * 3/1997 Crowell ..... A45C 13/08 206/457
5,649,581 A * 7/1997 Kopel ..... A45C 3/08 150/103
5,682,999 A * 11/1997 Larson ..... A63H 3/18 206/45.28
6,059,423 A 5/2000 Knopick
6,137,410 A 10/2000 Sepulveda
6,200,000 B1 3/2001 Burnidge
6,345,912 B1 * 2/2002 Ho ..... B65D 33/12 383/127
7,008,289 B2 * 3/2006 Norman ..... A63H 3/18 446/308
7,311,415 B1 12/2007 Burnidge
8,231,000 B2 * 7/2012 Gonzalez ..... B65D 25/20 206/459.1
8,763,286 B2 * 7/2014 Jin ..... G09F 1/04 40/124.03
2012/0051669 A1 * 3/2012 Keller ..... B65D 31/10 383/4

(Continued)

*Primary Examiner* — Jacob K Ackun
*Assistant Examiner* — Jenine Pagan
(74) *Attorney, Agent, or Firm* — Roger N. Chauza, PC

(57) ABSTRACT

A pop-up mechanism for use with a bag so that when operated by a user, a decorative object pops up from a hidden position within the bag to a position clearly in view. A twistable circular band is held within a sleeve at the top of the bag. The band has attached thereto at least one finger tab, and a pivotal post having an end to which the decorative object is attached. When the finger tab is operated, the band twists and thereby pivots the post and the decorative object from the hidden position to the viewable position.

16 Claims, 4 Drawing Sheets

(56) References Cited

U.S. PATENT DOCUMENTS

| | | | | |
|---|---|---|---|---|
| 2015/0055893 | A1* | 2/2015 | Schumacher | B65D 33/12 383/95 |
| 2016/0264303 | A1* | 9/2016 | Borges | B65D 33/004 |

* cited by examiner

HALLOWEEN BAG WITH POP-UP SURPRISE

TECHNICAL FIELD OF THE INVENTION

The present invention relates in general to novelty items, and more particularly to bags or containers equipped with apparatus that allows a user to deploys a pop-up item.

BACKGROUND OF THE INVENTION

Novelty items are popular as they are different and generate curiosity and excitement. Many novelty items are seasonal and are more popular during the holidays. For example, during the Halloween season, pumpkins, black cats, masks and costumes are readily available for children who celebrate the season. The popularity and widespread use of the various items often depends on the novelty of such items. Many novelty items are incorporated into bags for carrying items associated with the season of interest.

During the Halloween season, children traditionally go trick-or-treating with a conventional paper bag or a plastic bag for collecting candy and treats from neighborhood residents. The bags can also be purchased with Halloween decorations printed thereon to make them more special and different from the traditional grocery bags that are commonly used.

As an example of the novelty of Halloween bags, lighting has become popular and has been incorporated into bags for carrying candy and treats. With the low cost of batteries and LED lights, such equipment can be readily incorporated into Halloween bags without substantial additional cost. U.S. Pat. Nos. 6,200,000; 7,311,415 and 6,059,423 illustrate Halloween bags with different lighting schemes. U.S. Pat. No. 6,137,410 illustrates a Halloween bag having sound emitting capabilities.

From the foregoing, a need exists for a Halloween bag or container that is equipped with a manually operated mechanism that allows an object to pop up from within the bag. On further actuation, the object can be moved back into the bag and hidden from sight. This novelty item is unusual and can generate curiosity and excitement with children.

SUMMARY OF THE INVENTION

In accordance with the principles and concepts of the invention, disclosed is a Halloween container that includes apparatus that is finger operated to swing a post from a hidden position in the container, to a position where the post can be easily seen. The end of the post can be equipped with a novelty item, such as hand, ghost, black cat, etc. The apparatus can be again operated to move the post and the novelty item back to the hidden position.

In accordance with a feature of the invention, the apparatus includes a spring-like strip fastened around the opening of the container. The strip has one or more finger-operated tabs that can be operated to rotate or twist the strip. Attached to the strip is a lever or post that rotates with the strip. A novelty object can be fastened to the free end of the post. Accordingly, when the tabs are manually rotated, the strip rotates, as does the post attached thereto, thereby rotating the novelty item from within the container to a position in plain view of close observers.

According to another feature of the invention, the Halloween container can be a bag with loops formed around the opening of the bag. The plastic strip of the apparatus can be threaded through the loops to fasten the apparatus to the bag.

The user of the apparatus can thus hold the bag in an open condition and at the same time operate the finger tabs to deploy the movable post and thus the novelty item.

According to an embodiment of the invention, disclosed is a pop-up mechanism that includes a container for holding items therein, where the container has an opening through which a user of the container can place the items inside the container. A pop-up object is located inside the container in a position generally hidden from view. Further included is a mechanism responsive to actuation by the user of the container for moving the pop-up object from the hidden position to a position adjacent the opening of the container where the pop-up object can be seen.

According to another embodiment of the invention, disclosed is a pop-up mechanism that includes a bag for carrying items, where the bag has a top opening. Further included is a sleeve formed around a circumference of the top opening in the bag. A flexible band is enveloped by the sleeve, and the band is twistable within the sleeve. A pivotal post is fastened to the band so that the pivotal post is movable within the bag. The pivotal post protrudes through an opening in the sleeve. A finger tab is fastened to the band so that when the tab is manually manipulated, the flexible band rotates and thus rotates the pivotal post. A decorative object is fastened to an end of the pivotal post. Whereby when the finger tab is moved the flexible band rotates to thereby rotate the pivotal post from a position where the decorative object is hidden within the bag to a position where the decorative object is observable.

According to yet another embodiment of the invention, disclosed is a method of operating a pop-up mechanism. The method includes operating a finger tab to rotate a band located at a top opening of a container. The method further includes rotating a pivotal post attached to the band from a first position where a decorative object attached to an end of the pivotal post is hidden within the container, to a second position so that the decorative object is adjacent the opening of the container.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1:
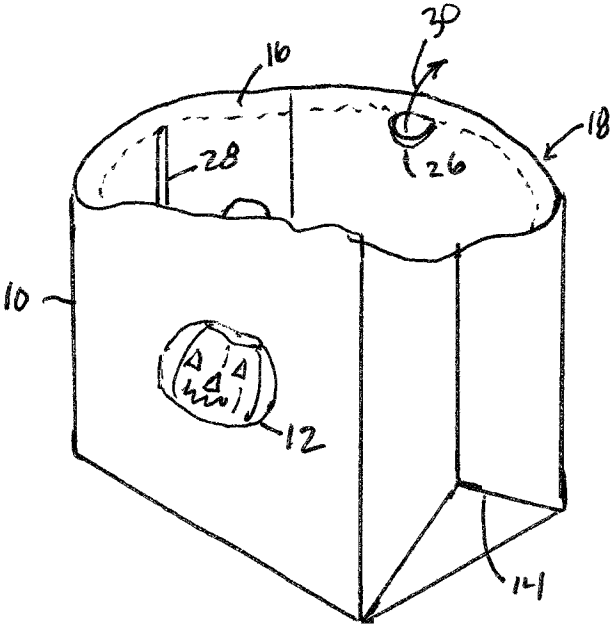
FIG. 1 is an isometric frontal view of a Halloween bag illustrating the finger tabs.

With reference to FIG. 1, there is illustrated a container for holding items, such as a Halloween bag 10. The bag 10 can be constructed of a heavy paper material that is self-supporting, or other suitable materials. The bag 10 can also be constructed of a plastic or other suitable material. Various designs can be embossed on the outer surface of the bag 10, such as a Halloween jack-o-lantern 12. The Halloween bag 10 is illustrated as being constructed with gussets 14, but other forms of bags or containers can be employed. Indeed, the invention can be incorporated into a hollow plastic pumpkin.

The Halloween bag 10 includes an open top having a sleeve 16 formed around the peripheral rim 18. The sleeve 16 can be formed by folding a flap of the top edge of the opening down onto itself and fastening the folded edge with an adhesive, or the like. A number of slots are formed into the sleeve 16 to allow threading of the plastic strip 20 (FIG. 3) therethrough, as well as allow finger tabs to protrude therefrom. Another opening in the sleeve 16 allows a pivotal post to protrude therefrom. As will be described in more detail below, the plastic strip is either threaded into the sleeve 16, or the plastic strip 20 is placed inside the top edge of the bag 10 and the paper material is folded down over the plastic strip 20 to enclose and capture the same. In any event, the plastic strip 20 is fastened around the top edge of the bag 10, but can rotate a certain amount.

Figure 3:
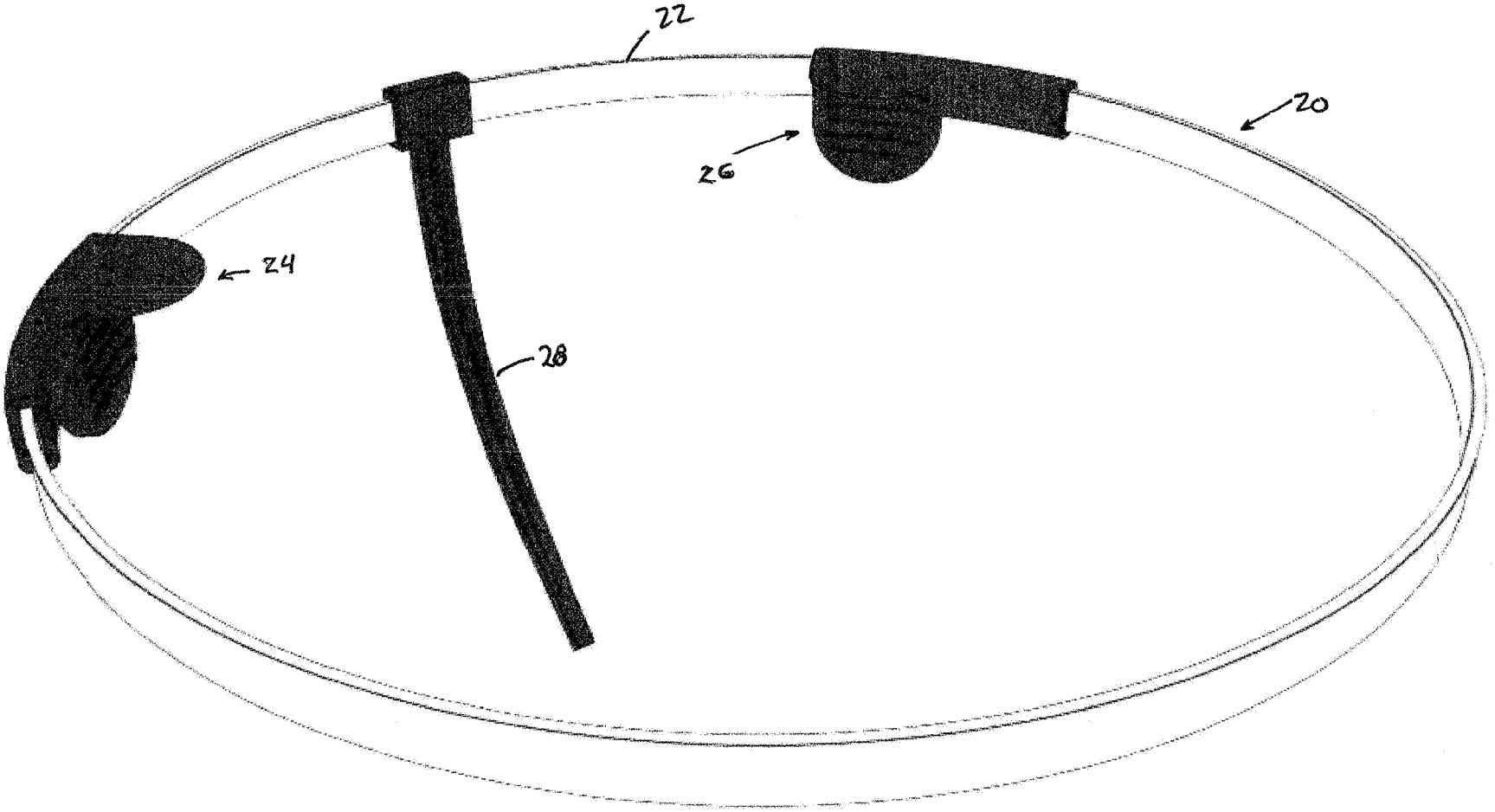
FIG. 3 is an isometric view of the twistable strip to which the finger tabs and pivotal post are attached, according to one embodiment of the invention.

The plastic strip 20 of FIG. 3 includes a band 22 and opposing finger tabs 24 and 26 attached thereto, as well as a pivotal post 28. The band 22 is rectangular in cross-sectional shape and is constructed of a stiff, but flexible material, such as plastic. The material should be of the type that can be twisted using the finger tabs 24 and 26, but returns to the original shape when the tabs 24 and 26 are released. As can be appreciated, when the tabs 24 and 26 are pulled upwardly, the band 22 will twist or rotate in a counterclockwise direction as shown. When the band 22 rotates, it carries with it the pivotal post 28.

Figure 2:
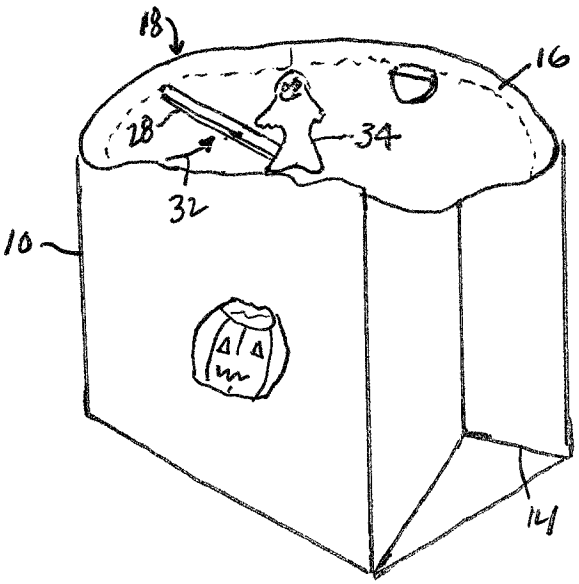
FIG. 2 is an isometric frontal view of FIG. 1, illustrating the operation of the finger tabs to deploy the hidden object.

Referring back to FIG. 1, when the finger tabs 24 and 26 are pulled upwardly, as shown by arrow 30, the band 22 rotates, and the pivotal post 28 also rotates in the direction of arrow 32 of FIG. 2. The rotation of the pivotal post 28 thus brings it into view near the top of the bag 10. As can be appreciated, the band 22 rotates within the sleeve 16 located around the top rim 18 of the bag 10. According to a feature of the invention, an object 34 can be fastened to the free end of the pivotal post 28. In the illustrations, an object in the form of a ghost 34 is fastened to the free end of the pivotal post 28. The object can be of many other forms, such as a black cat, a pumpkin, a scary face, a sign with the words "BOO," etc.

Figure 5:
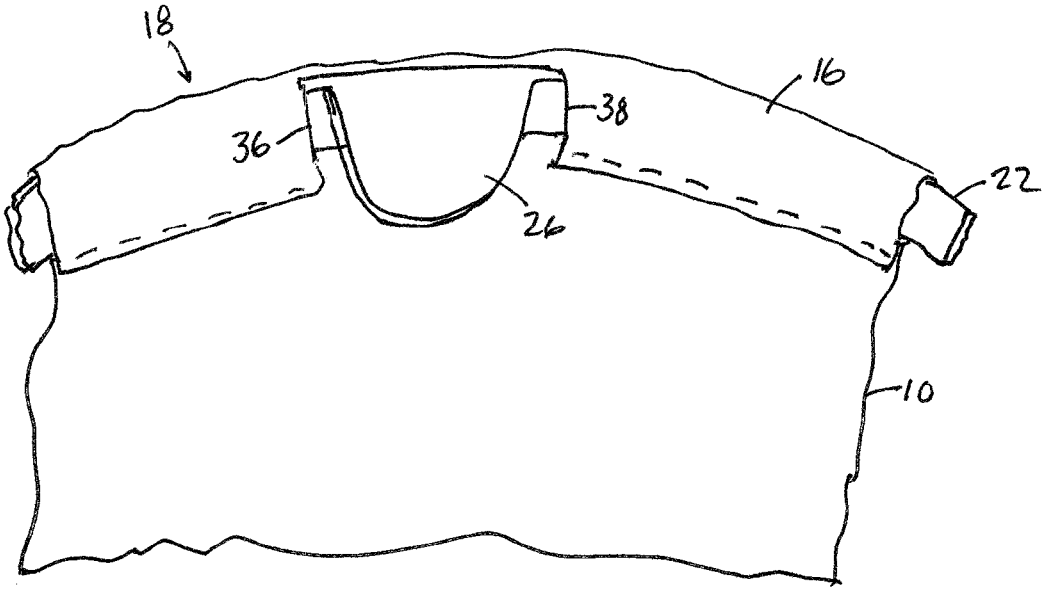
FIG. 5 is a partial view of the Halloween bag constructed with a sleeve on the rim, and a slot through which the finger tab protrudes.

With reference to FIG. 5, there is illustrated a portion of the bag 10 showing the sleeve 16 formed around the rim 18 of the bag 10. As noted above, the sleeve 16 is a portion of the top edge of the bag 10 that is folded down inside the bag 10 and bonded to the inside surface of the bag 10 to form an elongate pocket through which the band 22 extends. The sleeve 16 is of sufficient size to allow the band 22 to easily twist therein and return to its original shape.

The sleeve 16 includes open spaces, such as formed by spaced apart sleeve edges 36 and 38, to allow the finger tab 26 to protrude therefrom and not be covered by the sleeve 16. A second open space would be formed to accommodate the other finger tab 24. A third open space would be formed in the sleeve 16 to accommodate the pivotal post 28.

Returning to FIG. 3 of the drawings, the strip 20 is formed with the band 22 that is continuous and circular in shape, with no ends. The circular band 22 causes the opening in the bag 10 to also be generally circular in shape. Also illustrated are the inwardly turned finger tabs 24 and 26 located on the band 22, on each side of the pivotal post 28. The finger tabs 24 and 26 need not be on opposite sides of the band 22, but sufficiently spaced from the pivotal post 28 to allow it to rotate with the rotation of the finger tabs 24 and 26. The finger tabs 24 and 26 can be constructed with respective slots therein for sliding therethrough the band 22. The pivotal post 28 can also be formed with a slot therein to allow the band 22 to slide through it. With this arrangement, the components can be adjusted and located at desired locations on the band 22, and then the band 22 can be fastened within the sleeve 16. As an alternative, the two finger tabs 24 and 26, as well as the pivotal post 28, can be formed integral with the band 22 during the molding process.

Figure 4:
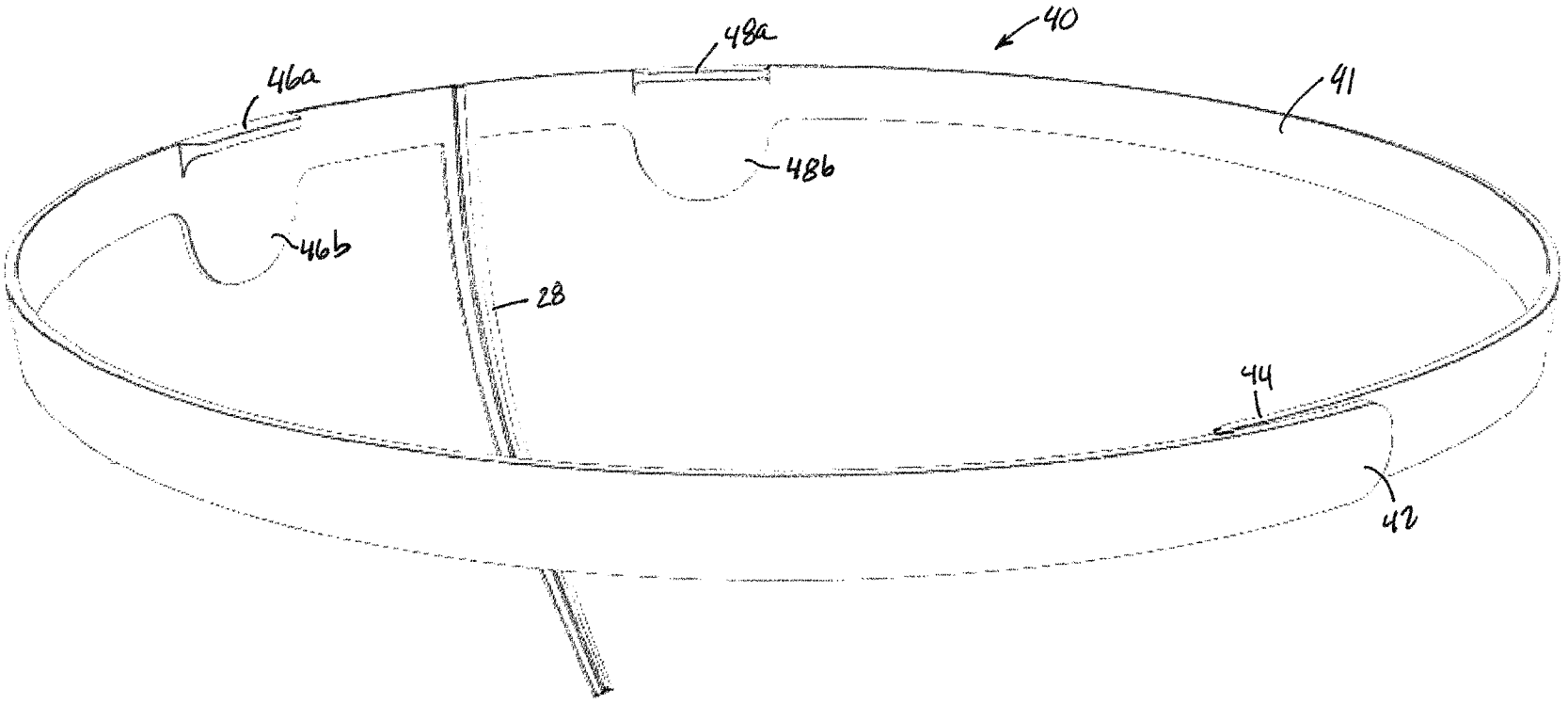
FIG. 4 is an isometric view of the twistable strip to which the finger tabs and pivotal post are attached, according to another embodiment of the invention.

FIG. 4 illustrates another embodiment of a plastic strip 40 that is constructed generally in a circular shape with a band 41 having ends 42 and 44 that overlap. While not shown, the ends 42 and 44 can be fastened together with male and female plastic snaps. With this configuration, the ends 42 and 44 can be used to thread the band 41 though the sleeve 16 of the bag 10. Moreover, in this embodiment, the pivotal post 28 is molded integral with the band 41, as are the pair of finger tabs 46*a* and 46*b*. The plastic strip 40 of this embodiment can also be fastened around the top rim 18 of the bag 10 by folding a flap on the top edge of the bag 10 down to encircle the band 41, and then bond the folded edge of the flap to the inside surface of the bag 10.

In the embodiment illustrated in FIG. 4, the finger tab 46*a* is accompanied by a companion finger tab 46*b*. The two finger tabs 46*a* and 46*b* are formed about 90 degrees apart. The companion finger tabs 48*a* and 48*b* are similarly constructed and formed integral with the band 41. The finger tabs 46*a* and 48*a* are pulled by the user of the bag 10 to pivot the post 28 upwardly to move the object fastened at the end of the post 28 upwardly and into view within the bag 10. If the pivotal post 28 does not return to the downward location hidden within the bag 10, then the other set of finger tabs 46*b* and 48*b* can be pushed by the user to assist in returning the pivotal post 28 to its hidden position. The pivotal post 28 may not return to its hidden position due to friction of the band 41 with the sleeve 16, whereupon the finger tabs 46*b* and 48*b* can be used to overcome the friction and untwist the band 41 within the sleeve 16.

The object 34 to be deployed from a hidden position in the bag 10 to a viewable position can be fastened at the end of the pivotal post 28 by bonding or other suitable means. Once the plastic strip 22 is installed in the bag 10, the object 34 can be bonded at the end of the post 28. As an alternative, the end of the post 28 can be constructed with a spring-type clamp to grasp the object 34. Other grasping mechanisms can be employed so that the user can change the object.

Figure 6:
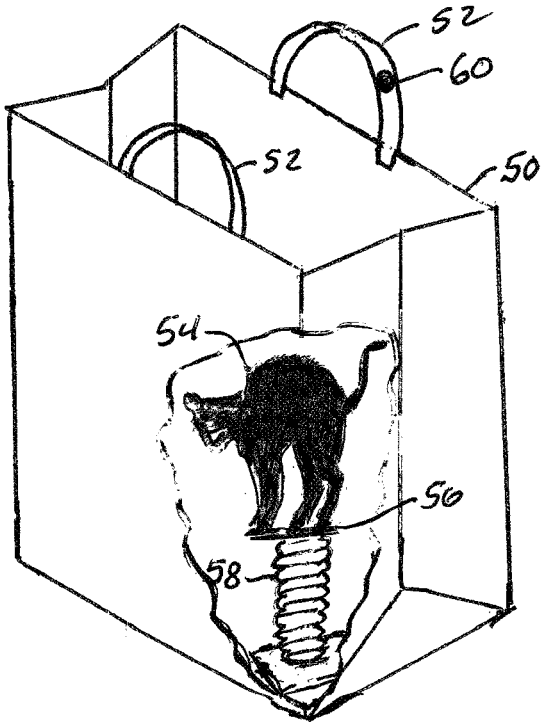
FIG. 6 illustrates another embodiment of a pop-up mechanism incorporated into a bag, a portion of which is cut out to show the pop-up object.

FIG. 6 illustrates another embodiment of a pop-up mechanism incorporated into a seasonal bag 50. The bag 50 is equipped with handholds 52 for grasping while holding and carrying the bag while in transit. In this embodiment, an object, such as a black cat 54, is hidden in the bag and is adapted for popping up on demand by the user of the bag 50. The cat 54 is attached to a platform 56, and the platform is coupled to a coiled spring 58. The coiled spring 58 is fastened to the floor of the bag 50. The actuation of the object 54 (black cat) can be much like that of a Jack-in-the Box toy for children. A button 60 can be fastened to one of the handholds 52, and when actuated, the spring 58 will be released so that the spring 58 expands upwardly and pops the black cat 54 from its hidden position to a position in view.

The button 60 can be an electrical switch which actuates a release mechanism so that the spring 58 is released from its coiled condition. Once released, the object 54 can be manually pushed back down into a hidden position where a latch would hold the spring 58 in the coiled condition. The wires (not shown) needed can be routed from the switch 60 through the handhold 52, alongside the inside surface of the bag 50 and to the release mechanism of the spring 58. Rather than using an electrical switch 60, a manual push-type switch can be employed to move an elongated flexible wire that engages with a release mechanism. The movement of the elongated wire via the switch can manually move the release mechanism to deploy the object 54.

While the principles and concepts of the invention have been described above in connection with a Halloween bag, other containers associated with other seasons or holidays can be used to provide the pop-up capabilities. The pop-up mechanism of the invention can be incorporated into gift bags, and the like. The bag employed with the pop-up mechanism is not limited to a paper bag, but can be utilized with cloth fabrics and woven synthetic materials as well. In addition, two or more pivotal posts can be fastened to the band so that all posts move with the rotation of the band. While the band is preferably constructed with a rectangular cross-sectional shape, other shapes can be employed. For example, the band can be round and rod-like so that it is rather rigid, but can rotate while oriented in a circle or oval shape of the opening of the bag. The sleeve can be of the type similar to the belt loops on pants, whereby the band would be threaded through the loops located at the top of the bag.

While the preferred and other embodiments of the invention have been disclosed with reference to specific pop-up mechanisms, and associated methods of construction thereof, it is to be understood that many changes in detail may be made as a matter of engineering choices without departing from the spirit and scope of the invention, as defined by the appended claims.

What is claimed is:

1. A pop-up mechanism, comprising:

a container for holding items therein, said container having an opening through which a user of the container can place the items inside the container;

a pop-up object located inside said container below said opening and in a position generally hidden from view;

a mechanism responsive to actuation by the user of said container for moving said pop-up object from the hidden position to a position adjacent the opening of said container where said pop-up object can be seen; and said mechanism including a band located around at least half of the opening of said container, and at least one finger tab attached to said band so that when a user of said container moves said finger tab, the band twists, and the pop-up object is operatively connected to said band so that the twisting movement of said band moves the pop-up object from the hidden position to the position in which the pop-up object can be seen.

2. The pop-up mechanism of claim 1, further including:

said band fastened entirely around the opening of said container;

a pivotal post fastened to said band; and a portion of said band being accessible for manual manipulation to rotate said band and pivot said pivotal post from a position hidden within said container to a position near the opening of said container.

3. The pop-up mechanism of claim 2, wherein said container comprises a bag.

4. The pop-up mechanism of claim 2, wherein said at least one finger tab defines a first finger tab, and further including a second finger tab, said first finger tab being manually manipulated to rotate said band in a first direction to move said pivotal post in a first direction, and said second finger tab being manually manipulated to rotate said band in a second direction to move said pivotal post in a second direction.

5. The pop-up mechanism of claim 4, wherein said first and second finger tabs define a first pair of finger tabs, and further including a second pair of finger tabs fastened to said band.

6. The pop-up mechanism of claim 1, wherein said container includes a sleeve for holding said band therein.

7. The pop-up mechanism of claim 6, wherein said sleeve comprises a flap of a top edge of said container folded to enclose at least a portion of said band.

8. The pop-up mechanism of claim 6, further including a pivotal post extending from said band, and wherein said sleeve has an opening therein through which said pivotal post protrudes.

9. The pop-up mechanism of claim 6, wherein said sleeve includes an opening therein through which a finger tab protrudes.

10. The pop-up mechanism of claim 2, further including in combination an object fastened to an end of said pivotal post, said object representative of a holiday season.

11. A pop-up mechanism, comprising:

a bag for carrying items, said bag having a top opening;

a sleeve formed around a circumference of the top opening in said bag, said sleeve having an opening therein;

a flexible band enveloped by said sleeve, said band being twistable within said sleeve;

a pivotal post fastened to said band so that said pivotal post is movable within said bag, said pivotal post protruding through said opening in said sleeve;

a finger tab fastened to said band so that when said finger tab is manually manipulated, said flexible band rotates and thus rotates said pivotal post;

a decorative object fastened to an end of said pivotal post; and whereby when said finger tab is moved said flexible band rotates to thereby rotate said pivotal post from a position where said decorative object is hidden within said bag to a position where said decorative object is observable.

12. The pop-up mechanism of claim 11, wherein said flexible band has a rectangular cross-sectional shape.

13. The pop-up mechanism of claim 12, wherein said band is constructed so that when said finger tab is released, the pivotal post returns to a position where said decorative object is hidden from view.

14. The pop-up mechanism of claim 11, wherein said finger tab defines a first finger tab, and further including a second finger tab fastened to said band.

15. The pop-up mechanism of claim 14, wherein said first and second finger tabs are spaced apart so that fingers of both hands of a person can simultaneously operate said finger tabs.

16. The pop-up mechanism of claim 14, wherein said first and second finger tabs are spaced from each other on said band about 30 degrees.

* * * * *